US009479863B2

(12) United States Patent
Chien

(10) Patent No.: US 9,479,863 B2
(45) Date of Patent: Oct. 25, 2016

(54) COMBO-JACK DETECTING CIRCUIT

(71) Applicant: REALTEK SEMICONDUCTOR CORPORATION, Hsinchu (TW)

(72) Inventor: Chih-Kang Chien, Hsinchu (TW)

(73) Assignee: REALTEK SEMICONDUCTOR CORPORATION, Hsinchu (TW)

( * ) Notice: Subject to any disclaimer, the term of this patent is extended or adjusted under 35 U.S.C. 154(b) by 663 days.

(21) Appl. No.: 13/873,870

(22) Filed: Apr. 30, 2013

(65) Prior Publication Data

US 2013/0315421 A1 Nov. 28, 2013

(30) Foreign Application Priority Data

May 28, 2012 (TW) ..... 101119027 A

(51) Int. Cl.

| | |
|---|---|
| ***H04R 1/10*** | (2006.01) |
| ***H02B 1/00*** | (2006.01) |
| ***H04R 3/00*** | (2006.01) |
| ***H04R 5/04*** | (2006.01) |

(52) U.S. Cl.

CPC . *H04R 3/00* (2013.01); *H04R 5/04* (2013.01)

(58) Field of Classification Search

CPC ..... H04R 3/00; H04R 5/04; H04R 5/033; H04R 1/1041

USPC ..... 381/74, 123

See application file for complete search history.

(56) References Cited

U.S. PATENT DOCUMENTS 5,995,633 A * 11/1999 Cappels ..... H04B 1/207 381/123
2005/0142916 A1 6/2005 Larn
2008/0032737 A1 2/2008 Liu et al.
2008/0150583 A1 6/2008 Lu et al.
2009/0316931 A1 12/2009 Dai et al.
2010/0215183 A1 8/2010 Hansson et al.
2012/0104870 A1* 5/2012 Chang ..... H01R 13/6683 307/125
2012/0114125 A1 5/2012 Xue et al.

FOREIGN PATENT DOCUMENTS

JP 2010-278691 A 12/2010
TW M301466 11/2006

OTHER PUBLICATIONS

CN Office Action dated Oct. 27, 2015 in corresponding Chinese application (No. 2001210175665.7).

* cited by examiner

*Primary Examiner* — Vivian Chin
*Assistant Examiner* — Douglas Suthers
(74) *Attorney, Agent, or Firm* — McClure, Qualey & Rodack, LLP

(57) ABSTRACT

A combo-jack detecting circuit for used in an audio CODEC is provided. The combo-jack detecting circuit comprises a low pass filter, a detecting unit and a switch unit. Without coupling capacitor between an audio apparatus and audio codec, the output direct current voltage of the audio apparatus can be provided by the low pass filter. The switch unit is configured to switch selectively for outputting two voltage signals to the low pass filter sequentially. The low pass filter provides two direct current signals so that the detecting unit determines a jack type of the sounding signal apparatus accordingly. By means of proper design, input buffers in the audio codec can transform a common mode voltage of the audio apparatus into a common mode voltage of the audio codec.

11 Claims, 5 Drawing Sheets

COMBO-JACK DETECTING CIRCUIT

This application claims priority to Taiwan Patent Application No. 101119027 filed on May 28, 2012, which is hereby incorporated by reference in its entirety.

CROSS-REFERENCES TO RELATED APPLICATIONS

Not applicable.

BACKGROUND OF THE INVENTION

1. Field of the Invention

The present invention relates to a combo-jack detecting circuit for use in an audio codec. More particularly, the combo-jack detecting circuit of the present invention is configured to detect a jack type of a combo-jack.

2. Descriptions of the Related Art

Many audio apparatuses currently available in the market need to have a simultaneous audio output and input function (e.g., headsets). Most of the existing audio apparatuses have an audio input jack and an audio output jack, which are originally independent from each other, and then integrated into a single combo-jack for convenience. The combo-jack of such an audio apparatus with four terminals is normally provided with a left-sound channel audio output terminal, a right-sound channel audio output terminal, an audio input terminal and a ground terminal. Only in this way, can the audio apparatus play, via a speaker thereof, a sound signal transmitted from an audio codec and output the received sound signal via the audio input terminal to the audio codec for subsequent processing.

Accordingly, to meet the aforesaid requirements, the combo-jacks currently available adopt four terminals mostly in the form of TRRS (i.e., a terminal Tip, a terminal Ring1, a terminal Ring2 and a terminal Sleeve). To make a combo-jack downward compatible with a common apparatus (e.g., an earphone) with only an input jack, the terminal Tip and the terminal Ring1 of the combo-jack are fixedly used as the left-sound channel audio output terminal and the right-sound channel audio output terminal respectively. However, on the other hand, the audio input terminal or the ground terminal of the combo-jack is not mandatorily specified to necessarily correspond to the terminal Ring2 and the terminal Sleeve, so when a designer of audio systems integrates an audio codec with a combo-jack of an audio apparatus, the audio output terminals, the audio input terminal and the ground terminal of the audio codec usually must be designed to match those of the combo-jack.

In more detail, when the combo-jack of the audio apparatus uses the terminal Ring2 as the ground terminal and uses the terminal Sleeve as the audio input terminal, the designer of audio systems must design the circuit of the audio codec correspondingly so that the grounding circuit of the audio codec comes into contact with the terminal Ring2 while the audio input terminal of the audio codec comes into contact with the terminal Sleeve. Likewise, when the combo-jack of the audio apparatus uses the terminal Ring2 as the audio input terminal and uses the terminal Sleeve as the ground terminal, the designer of audio systems must design the circuit of the audio codec correspondingly so that the grounding circuit of the audio codec comes into contact with the terminal Sleeve, while the audio input terminal of the audio codec comes into contact with the terminal Ring2.

Thus, when the designer of audio systems manufactures the audio codec, the circuit design of the audio codec will be limited by the jack implementation of the combo-jack of the audio apparatus with which the audio codec is to match. Moreover, on the other hand, when a user desires to use an audio apparatus with a single combo-jack among apparatuses with different audio codecs, the user may fail to obtain the expected effect due to incompatibility between the audio codecs and the combo-jack.

In view of this, it is important to provide a circuit disposed within an audio codec, which can determine the jack implementation of a combo-jack of an audio apparatus to ensure that different combo-jacks can all operate on the audio codec normally.

SUMMARY OF THE INVENTION

An objective of the present invention is to provide a combo-jack detecting circuit for use in an audio codec, which can detect circuits of combo-jacks of audio apparatuses and determine possible jack implementations of the combo-jacks of the audio apparatuses accordingly so that the combo-jacks of the different audio apparatuses can all operate on the audio codec normally. As a result, the user can operate the audio apparatuses and the audio codec more smoothly.

To achieve the aforesaid objective, the present invention discloses a combo-jack detecting circuit for use in an audio codec, which connects with an audio apparatus electrically. The audio apparatus comprises a first terminal and a second terminal. The combo-jack detecting circuit comprises a low pass filter, a detecting unit coupled to the low pass filter, and a switch unit. The switch unit is coupled to the first terminal, the second terminal and the low pass filter, and selectively switches to output a first voltage signal of the first terminal and a second voltage signal of the second terminal to the low pass filter in order. The low pass filter receives the first voltage signal and the second voltage signal via the switch unit and provides a first direct current signal of the first voltage signal and a second direct current signal of the second voltage signal respectively. The detecting unit determines a jack type of the audio apparatus according to the first direct current signal and the second direct current signal.

With the technical features disclosed above, the combo-jack detecting circuit of the present invention can determine a jack type of a combo-jack by switching on two circuits between the combo-jack detecting circuit and the combo-jack and according to peak voltages of direct current signals of the two circuits. The detailed technology and preferred embodiments implemented for the subject invention are described in the following paragraphs accompanying the appended drawings for people skilled in this field to well appreciate the features of the claimed invention.

DESCRIPTION OF THE PREFERRED EMBODIMENT

In the following descriptions, the present invention will be explained with reference to embodiments thereof. However, these embodiments are not intended to limit the present invention to any specific environments, applications or particular implementations described in these embodiments. Therefore, the description of these embodiments is only for purpose of illustration rather than to limit the present invention. It shall be appreciated that in the following embodiments and the attached drawings, elements not directly related to the present invention are omitted from depiction; and dimensional relationships among individual elements in the attached drawings are illustrated only for ease of understanding but not to limit the actual scale.

Figure 1:
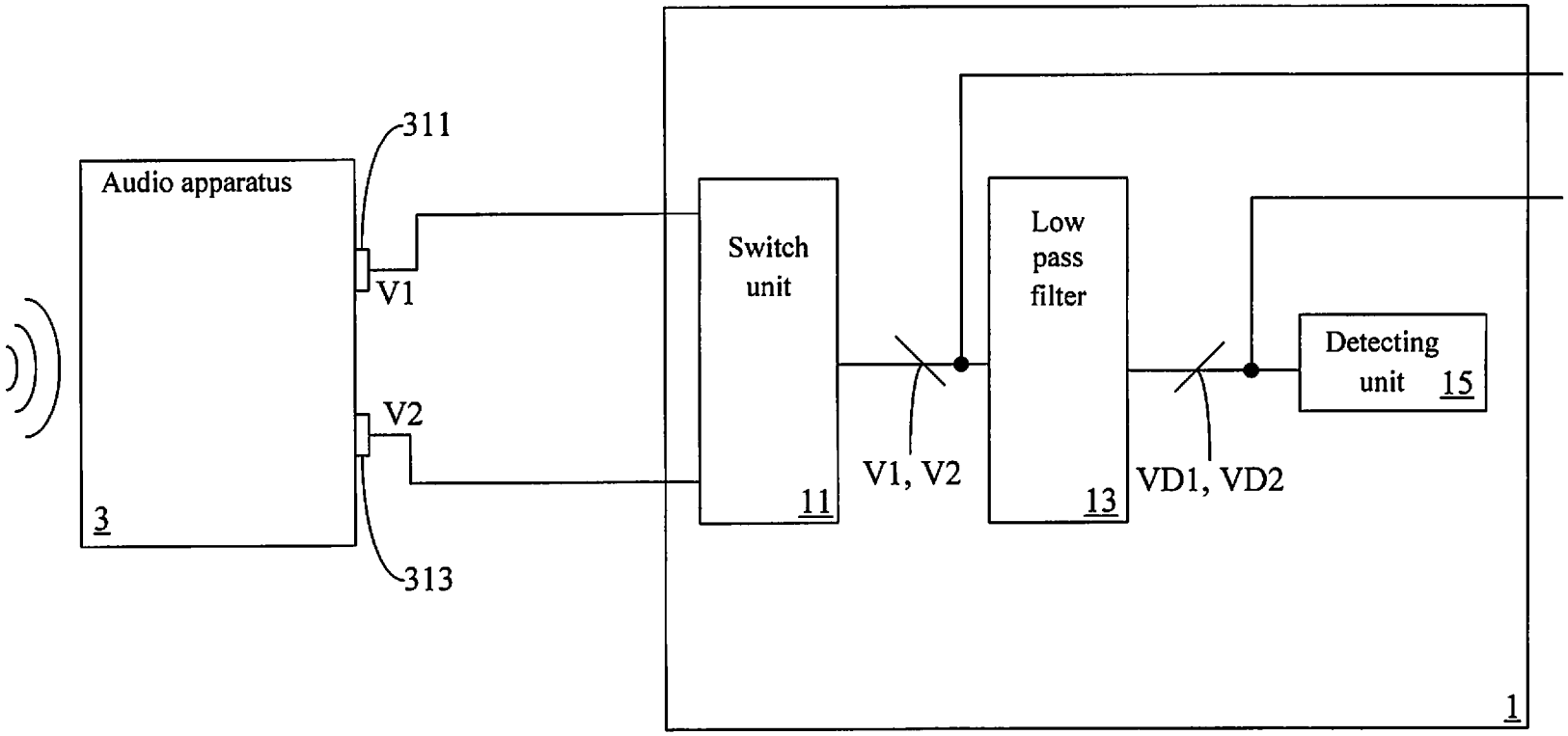
FIG. 1 is a schematic view of a combo-jack detecting circuit according to a first embodiment of the present invention.

FIG. 1 illustrates a schematic view of a combo-jack detecting circuit 1 according to a first embodiment of the present invention. The combo-jack detecting circuit 1 is electrically connected with an audio apparatus 3 to detect a jack status of the audio apparatus 3. The audio apparatus 3 comprises a first terminal 311 and a second terminal 313. The combo-jack detecting circuit 1 comprises a switch unit 11, a low pass filter 13, and a detecting unit 15 coupled to the low pass filter 13. It shall be firstly appreciated that the combo-jack detecting circuit 1 of the present invention may be disposed in an audio codec rather than being limited to being externally connected to the audio codec; and interactions between the elements will be further elucidated herein below.

Firstly, as shown, because the jack type of the audio apparatus 3 is unknown, the combo-jack detecting circuit 1 must firstly detect voltages of terminals of the audio apparatus 3 in the current circuit connection mode to confirm the jack type of the audio apparatus 3. Specifically, as shown in FIG. 1, when the audio apparatus 3 is connected to the combo-jack detecting circuit 1 via a jack, the switch unit 11 is externally coupled to the first terminal 311 and the second terminal 313 of the audio apparatus 3, and the switch unit 11 is internally coupled to the low pass filter 13.

With the disposition of the switch unit, the combo-jack detecting circuit 1 can determine the jack type of the audio apparatus 3 by detecting voltages of different terminals between the combo-jack detecting circuit 1 and the audio apparatus 3 when a user uses the audio apparatus 3. In more detail, the switch unit 11 selectively switches to output a first voltage signal V1 of the first terminal 311 and a second voltage signal V2 of the second terminal 313 to the low pass filter 13 in order. Then, the detecting unit 15 can carry out subsequent operations for determining the jack type of the audio apparatus 3.

Because the first voltage signal V1 and the second voltage signal V2 comprise alternating current voltage signals, the direct current signals of the first voltage signal V1 and the second voltage signal V2 may be firstly provided by the low pass filter 13 to increase the determination accuracy. It shall be particularly appreciated that providing the direct current signals by the low pass filter is known in the prior art and, thus, will not be further described herein.

Furthermore, the low pass filter 13 can receive the first voltage signal V1 and then filter out a first direct current signal VD1 of the first voltage signal V1. Likewise, the low pass filter 13 can receive the second voltage signal V2 and then filter out a second direct current signal VD2 of the second voltage signal V2. Thus, the detecting unit 15 can determine the jack type of the audio apparatus 3 according to the first direct current signal VD1 and the second direct current signal VD2.

In more detail, the detecting unit 15 can determine that the first terminal 311 of the audio apparatus 3 is a signal input terminal and the second terminal 313 is a ground terminal when the value of the first direct current signal VD1 is greater than the value of the second direct current signal VD2. The switch unit 11 further connects the second terminal 313 to the ground according to the determination result of the detecting unit 15. In this way, the audio apparatus 3 can input the signal to the audio codec properly so that the audio codec carries out subsequent operations.

Conversely, the detecting unit 15 can determine that the first terminal 311 of the audio apparatus 3 is a ground terminal and the second terminal 313 is a signal input terminal when the value of the first direct current signal VD1 is smaller than the value of the second direct current signal VD2. The switch unit 11 connects the first terminal 311 to the ground according to the determination result of the detecting unit 15. Likewise, the audio apparatus 3 can also input the signal to the audio codec properly in a different jack connection mode so that the audio codec carries out subsequent operations.

Figure 2A:
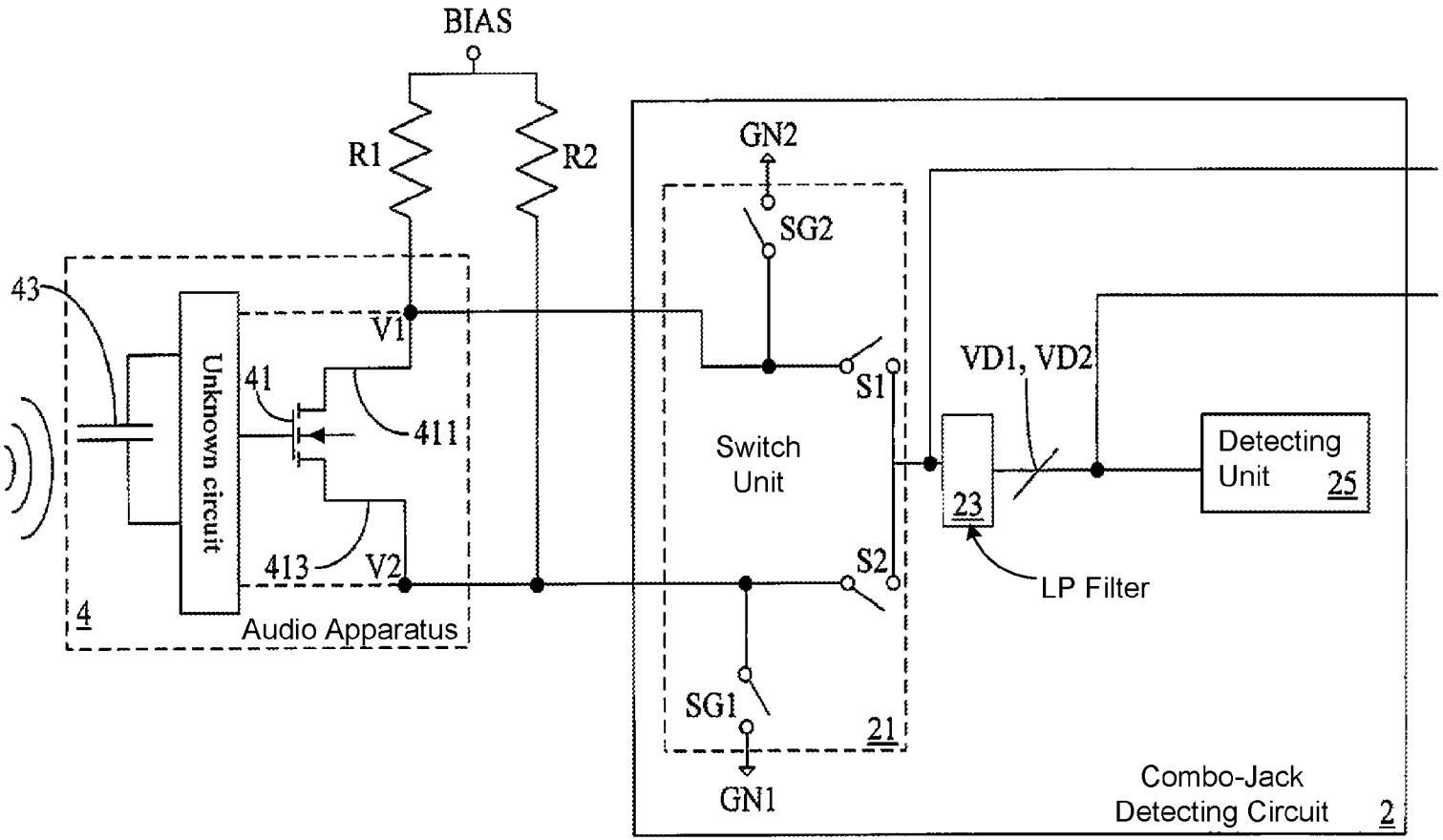
FIG. 2A is a schematic view of a combo-jack detecting circuit according to a second embodiment of the present invention.

Next, FIG. 2A shows a schematic view of a combo-jack detecting circuit 2 according to a second embodiment of the present invention. The combo-jack detecting circuit 2 is electrically connected with an audio apparatus 4 to detect a jack status of the audio apparatus 4. The audio apparatus 4 could be at least modeled as a transistor 41 and a sensing capacitor 43 coupled to the transistor 41. The transistor 41 comprises a first terminal 411 and a second terminal 413. The first terminal 411 and the second terminal 413 of the audio apparatus 4 are coupled to a stable bias voltage BIAS via a first resistor R1 and a second resistor R2 respectively. The audio apparatus 4 is activated mainly by the stable bias voltage BIAS.

On the other hand, the combo-jack detecting circuit 2 comprises a switch unit 21, a low pass filter 23, and a detecting unit 25 coupled to the low pass filter 23. The switch unit 21 comprises a first switch set and a second switch set. The first switch set comprises a first ground control switch SG1 and a first detection control switch S1. The second switch set comprises a second ground control switch SG2 and a second detection control switch S2. Likewise, the combo-jack detecting circuit 2 of the present invention may be disposed in an audio codec rather than being limited to being externally connected to the audio codec. Interactions between the elements will be further elucidated hereinbelow.

As shown, because the jack type (i.e., the circuit connection mode between the sensing capacitor 43 and the transistor 41) of the audio apparatus 4 is unknown (represented by an unknown circuit and dashed lines), the combo-jack detecting circuit 2 must firstly detect voltages of terminals of the audio apparatus 4 in the current circuit connection mode to confirm the jack type of the audio apparatus 4. Specifically, as shown in FIG. 2A, when the audio apparatus 4 is connected to the combo-jack detecting circuit 2 via a jack, the low pass filter 23 is coupled to the first terminal 411 and the second terminal 413 of the transistor 41 via the first detection control switch S1 and the second detection control switch S2 respectively, the first ground control switch SG1 is coupled between the second terminal 413 and a first ground end GN1, while the second ground control switch SG2 is coupled between the first terminal 411 and a second ground end GN2.

With the disposition of the switch unit, the combo-jack detecting circuit 2 can determine the jack type (i.e., the circuit connection mode between the sensing capacitor 43 and the transistor 41) of the audio apparatus 4 by detecting voltages of different terminals between the combo-jack detecting circuit 2 and the audio apparatus 4 when the user uses the audio apparatus 4. In more detail, because the stable bias voltage BIAS is mainly used to activate the audio apparatus 4, a stable direct current voltage signal can be supplied to the transistor 41 by the stable bias voltage BIAS via the first resistor R1 when the first ground control switch GN1 and the first detection control switch S1 are switched on and the second ground control switch GN2 and the second detection control switch S2 are switched off. Meanwhile, when the user uses the audio apparatus 4, the sensing capacitor 43 also generates voltage variations according to the vibrations of a sound, and supplies an alternating current voltage signal to the transistor 41. Thus, a first voltage signal V1 is formed by the stable bias voltage BIAS and the sensing capacitor 43 at the first terminal 411.

On the other hand, when the second ground control switch GN2 and the second detection control switch S2 are switched on and the first ground control switch GN1 and the first detection control switch S1 are switched off, the stable bias voltage BIAS supplies a stable direct current voltage signal to the transistor 41 via the second resistor R2. Likewise, when the user uses the audio apparatus 4, the sensing capacitor 43 also generates voltage variations according to the vibrations of a sound, and supplies an alternating current voltage signal to the transistor 41. Thus, a second voltage signal V2 is formed by the stable bias voltage BIAS and the sensing capacitor 43 at the second terminal 413.

Then, the detecting unit 25 can carry out subsequent operations for determining the jack type of the audio apparatus 4. Because the first voltage signal V1 and the second voltage signal V2 comprise alternating current voltage signals, the direct current signals of the first voltage signal V1 and the second voltage signal V2 may be firstly provided by the low pass filter 23 to increase the determination accuracy. It shall be particularly appreciated that providing the direct current signals by the low pass filter is known in the prior art and, thus, will not be further described herein.

Furthermore, when the first voltage signal V1 is formed by the stable bias voltage BIAS and the sensing capacitor 43 at the first terminal 411, the low pass filter 23 can receive the first voltage signal V1 via the first detection control switch S1 that is switched on, and then provide a first direct current signal VD1 of the first voltage signal V1. Likewise, when the second voltage signal V2 is formed by the stable bias voltage BIAS and the sensing capacitor 43 at the second terminal 413, the low pass filter 13 can receive the second voltage signal V2 via the second detection control switch S2 that is switched on, and then provide a second direct current signal VD2 of the second voltage signal V2.

Then, the detecting unit 25 can detect a first peak voltage (not shown) of the first direct current signal VD1 and second peak voltage (not shown) of the second direct current signal VD2, and determine the jack type of the audio apparatus 4 according to the first peak voltage and the second peak voltage. Thus, the detecting unit 25 can reduce the instability caused by the alternating current signals to increase the determination accuracy.

Figure 2B:
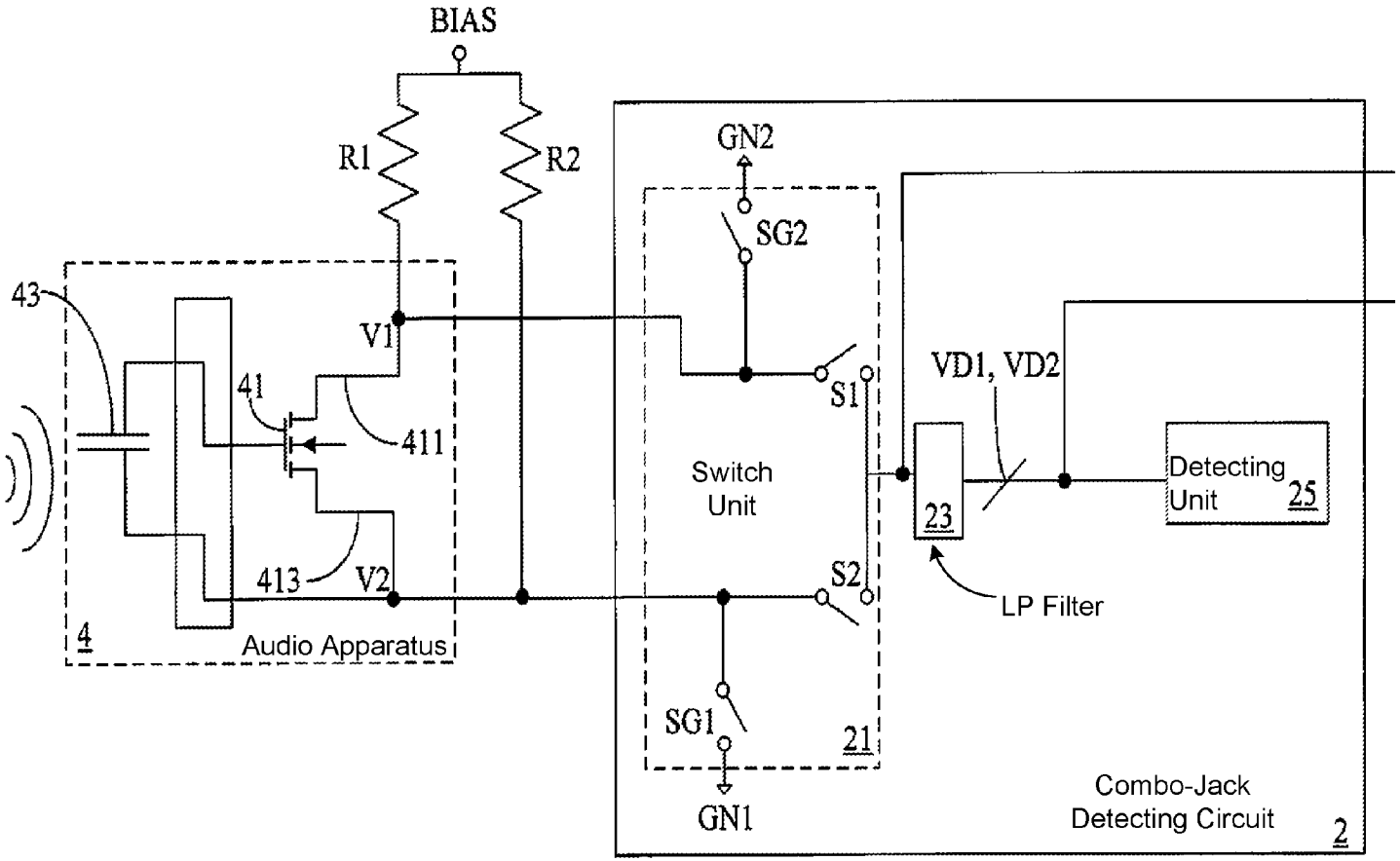
FIG. 2B is a schematic view illustrating a circuit connection mode between the combo-jack detecting circuit and an audio apparatus according to the second embodiment of the present invention.

FIG. 2B illustrates a schematic view of a circuit connection mode between the combo-jack detecting circuit 2 and the audio apparatus 4 according to the second embodiment of the present invention. It shall be firstly particularly appreciated that when the circuit of the audio apparatus 4 is as shown in FIG. 2B in which two terminals of the sensing capacitor 43 are connected to a gate and the second terminal 413 of the transistor 41 respectively, the correct circuit between the audio apparatus 4 and the stable bias voltage BIAS shall be that the stable bias voltage BIAS inputs the direct current voltage signal to the transistor 41 from the first terminal 411 via the first resistor R1 and the second terminal 413 of the transistor 41 is connected to the first ground end GN1. In this case, the first peak voltage of the first direct current signal VD1 will be greater than the second peak voltage of the second direct current signal VD2 in this normal circuit connection mode.

In other words, when the detecting unit 25 detects that the first peak voltage of the first direct current signal VD1 is greater than the second peak voltage of the second direct current signal VD2 through what is described in the aforesaid embodiment, the detecting unit 25 can determine that the circuit of the audio apparatus 4 shall be as shown in FIG. 2B (i.e., the first terminal 411 of the transistor 41 is connected to the stable bias voltage BIAS via the first resistor R1, and the second terminal 413 of the transistor 41 is connected to the first ground end GN1). Accordingly, the switch unit 21 can further connect the second terminal 413 to the ground (i.e., have the first ground control switch SG1 switched on and the second ground control switch SG2 switched off) according to the determination result of the detecting unit 25 so that the audio codec processes the first voltage signal V1 as the primary signal source.

Figure 2C:
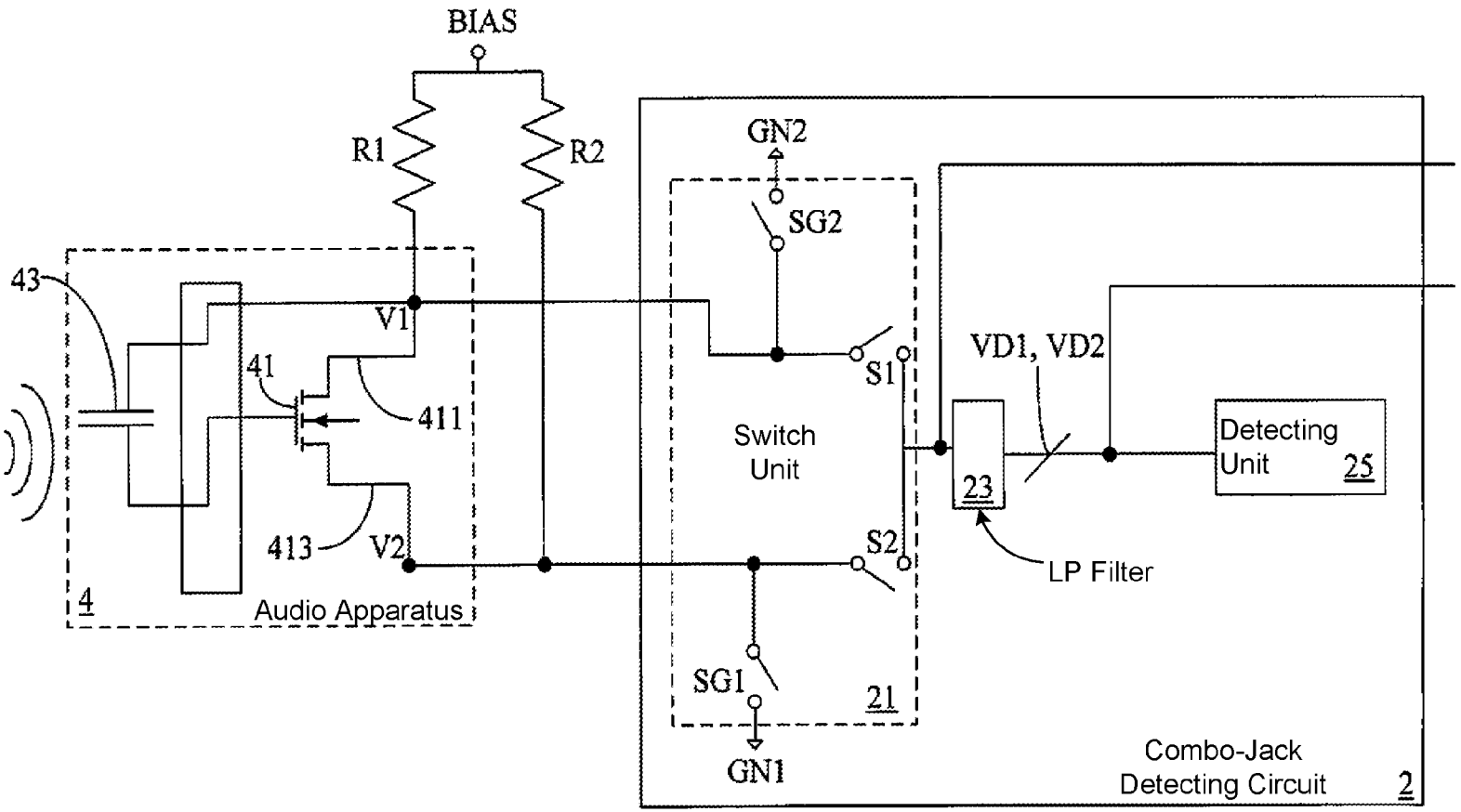
FIG. 2C is a schematic view illustrating another circuit connection mode between the combo-jack detecting circuit and the audio apparatus according to the second embodiment of the present invention.

Similarly, FIG. 2C illustrates a schematic view of another circuit connection mode between the combo-jack detecting circuit 2 and the audio apparatus 4 according to the second embodiment of the present invention. Likewise, when the circuit of the audio apparatus 4 is as shown in FIG. 2C in which two terminals of the sensing capacitor 43 are connected to a gate and the first terminal 411 of the transistor 41 respectively, the correct circuit between the audio apparatus 4 and the stable bias voltage BIAS shall be that the stable bias voltage BIAS inputs the direct current voltage signal to the transistor 41 from the second terminal 413 via the second resistor R2 and the first terminal 411 of the transistor 41 is connected to the second ground end GN2. In this case, the second peak voltage of the second direct current signal VD2 will be greater than the first peak voltage of the first direct current signal VD1 in this normal circuit connection mode.

In other words, when the detecting unit 25 detects that the second peak voltage of the second direct current signal VD2 is greater than the first peak voltage of the first direct current signal VD1 through what is described in the aforesaid embodiment, the detecting unit 25 can determine that the circuit of the audio apparatus 4 shall be as shown in FIG. 2C (i.e., the second terminal 413 of the transistor 41 is connected to the stable bias voltage BIAS via the second resistor R2, and the first terminal 411 of the transistor 41 is connected to the second ground end GN2). Accordingly, the switch unit 21 can further connect the first terminal 411 to the ground (i.e., with the second ground control switch SG2 switched on and the first ground control switch SG1 switched off) according to the determination result of the detecting unit 25 so that the audio codec processes the second voltage signal V2 as the primary signal source.

Figure 3:
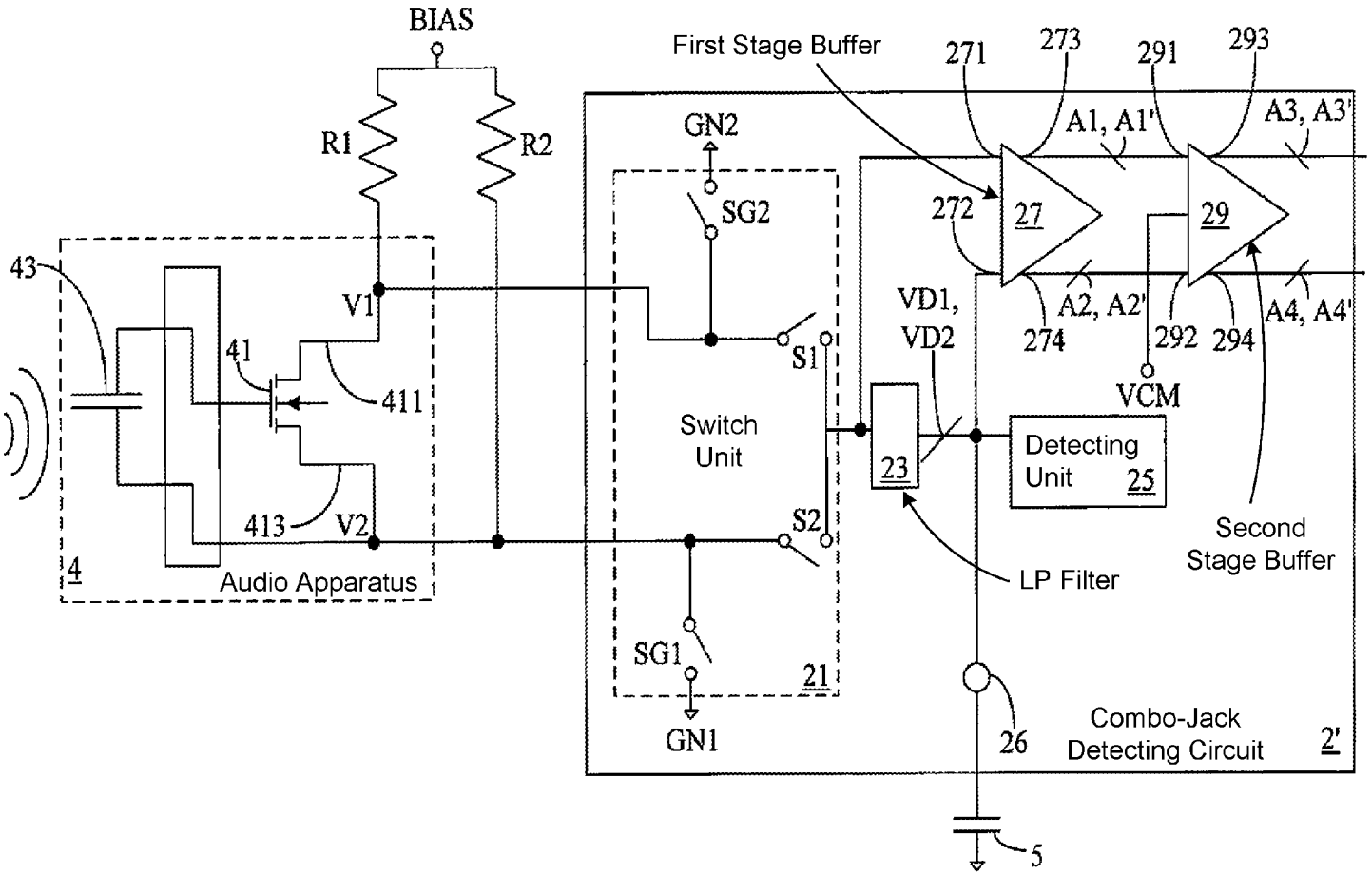
FIG. 3 is a schematic view of a combo-jack detecting circuit according to a third embodiment of the present invention.

Next, FIG. 3 illustrates a schematic view of a combo-jack detecting circuit 2' according to a third embodiment of the present invention. The combo-jack detecting circuit 2' further comprises a capacitor pin 26, a first stage buffer 27 and a second stage buffer 29. The first stage buffer 27 has a first input terminal 271, a second input terminal 272, a first output terminal 273 and a second output terminal 274. The second stage buffer 29 is coupled to a common mode contact VCM, and has a first input terminal 291, a second input terminal 292, a first output terminal 293 and a second output terminal 294. It shall be particularly appreciated that elements with the same designations in the third embodiment and the second embodiment have similar functions and, thus, will not be further described herein. However, the third embodiment will focus on the functions of the capacitor pin and the two stage buffers.

Specifically, the function of the capacitor pin 26 is to enhance the direct current signal filtering effect of the low pass filter 23. Furthermore, when the capacitor pin 26 is coupled between the low pass filter 23 and the detecting unit 25 and electrically connected to an external capacitor 5 (which may be a capacitor with a large capacitance), the direct current signal filtering effect of the low pass filter 23 can be further enhanced to ensure that the determination result of the detecting unit 25 is correct and, at the same time, the filtered direct current signal is transmitted to the buffers.

On the other hand, the stable bias voltage BIAS for activating the audio apparatus 4 and the direct current signal obtained by the audio apparatus 4 may be different from the direct current operating voltage in the audio codec, and this will cause the audio codec to be prone to errors during subsequent coding/decoding operations. Accordingly, before a signal is inputted to the audio codec, the signal must be properly processed by the buffers to adjust an operating voltage of the signal to be identical to the operating voltage of the audio codec. Specifically, in the case in which the first voltage signal V1 is used as the primary signal source as an example, the first input terminal 271 is coupled between the switch unit 21 and the low pass filter 23 to receive the first voltage signal V1 directly, and the second input terminal 272 is coupled between the low pass filter 23 and the detecting unit 25 to receive the first direct current signal VD1.

In this case, the first stage buffer 27 can convert the inputted first voltage signal V1 (comprising the first direct current signal VD1) and the inputted first direct current signal VD1 into a first alternating current signal A1 and a second alternating current signal A2 corresponding to the first voltage signal V1 and the first direct current signal VD1 (i.e., the first alternating current signal A1 and the second alternating current signal A2 with a first direct current signal level), and output the first alternating current signal A1 and the second alternating current signal A2 via the first output terminal 273 and the second output terminal 274 respectively. Phases of the first alternating current signal A1 and the second alternating current signal A2 are opposite.

Then, the first input terminal 291 coupled to the first output terminal 273 receives the first alternating current signal A1, and the second input terminal 292 coupled to the second output terminal 274 receives the second alternating current signal A2. Accordingly, the second stage buffer 29 can, on the basis of a common mode voltage signal (not shown) of the common mode contact VCM, convert the inputted first alternating current signal A1 and the inputted second alternating current signal A2 into a third alternating current signal A3 and a fourth alternating current signal A4 which are based on a level of the common mode voltage signal, and output the third alternating current signal A3 and the fourth alternating current signal A4 via the first output terminal 293 and the second output terminal 294 respectively. Phases of the third alternating current signal A3 and the fourth alternating current signal A4 are opposite. Thus, the signal source (i.e., the third alternating current signal A3 and the fourth alternating current signal A4) of the audio codec is signals based on the level of the common mode voltage signal, so the subsequent coding/decoding operations can be carried out normally.

On the other hand, in the case in which the second voltage V2 is used as the primary signal source as an example, the first input terminal 271 is coupled between the switch unit 21 and the low pass filter 23 to receive the second voltage V2 directly, and the second input terminal 272 is coupled between the low pass filter 23 and the detecting unit 25 to receive the second direct current signal VD2. In this case, the first stage buffer 27 can convert the inputted second voltage V2 (comprising the second direct current signal VD2) and the inputted second direct current signal VD2 into a first alternating current signal A1' and a second alternating current signal A2' corresponding to the second voltage V2 and the second direct current signal VD2 (i.e., the first alternating current signal A1' and the second alternating current signal A2' have a second direct current signal level), and output the first alternating current signal A1' and the second alternating current signal A2' via the first output terminal 273 and the second output terminal 274 respectively. Phases of the first alternating current signal A1' and the second alternating current signal A2' are opposite.

Then, the first input terminal 291 coupled to the first output terminal 273 receives the first alternating current signal A1', and the second input terminal 292 coupled to the second output terminal 274 receives the second alternating current signal A2'. Accordingly, the second stage buffer 29 can also, on the basis of a common mode voltage signal of the common mode contact VCM, convert the inputted first alternating current signal A1' and the inputted second alternating current signal A2' into a third alternating current signal A3' and a fourth alternating current signal A4' which are based on a level of the common mode voltage signal, and output the third alternating current signal A3' and the fourth alternating current signal A4' via the first output terminal 293 and the second output terminal 294 respectively. Phases of the third alternating current signal A3' and the fourth alternating current signal A4' are opposite. Thus, the signal source (i.e., the third alternating current signal A3' and the fourth alternating current signal A4') of the audio codec is a signal based on the level of the common mode voltage signal, so the subsequent coding/decoding operations can be carried out normally.

According to the above descriptions, the combo-jack detecting circuit of the present invention can detect circuits of combo-jacks of audio apparatuses and determine possible jack implementations of the combo-jacks of the audio apparatuses accordingly so that the combo-jacks of the different audio apparatuses can all operate on the audio codec normally and thus, the user can operate the audio apparatuses and the audio codec more smoothly.

The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. A combo-jack detecting circuit for use in an audio codec, connecting with an audio apparatus electrically, the audio apparatus comprising a first terminal and a second terminal, the combo-jack detecting circuit comprising:

a switch unit, being coupled to the first terminal and the second terminal, and selectively switching to output a first voltage signal of the first terminal or a second voltage signal of the second terminal;

a detecting unit, being coupled to the switch unit to receive the first voltage signal and the second voltage signal, and determining a jack type of the audio apparatus according to the first voltage signal and the second voltage signal;

a low pass filter, being coupled between the switch unit and the detecting unit; wherein the low pass filter receives the first voltage signal and the second voltage signal via the switch unit and provides a first direct current signal of the first voltage signal and a second direct current signal of the second voltage signal respectively, and the detecting unit determines the jack type of the audio apparatus according to the first direct current signal and the second direct current signal; and a first stage buffer, having a first input terminal, a second input terminal, a first output terminal and a second output terminal, wherein the first input terminal of the first stage buffer is coupled between the switch unit and the low pass filter to receive the second voltage signal, the second input terminal of the first stage buffer is coupled between the low pass filter and the detecting unit to receive the second direct current signal, the first output terminal and the second output terminal of the first stage buffer respectively output a first alternating current signal corresponding to the second voltage signal and a second alternating current signal corresponding to the second direct current signal, and phases of the first alternating current signal and the second alternating current signal are opposite.

2. The combo-jack detecting circuit as claimed in claim 1, further comprising: a capacitor pin, being coupled between the low pass filter and the detecting unit, and connecting to an external capacitor electrically.

3. The combo-jack detecting circuit as claimed in claim 1, wherein the detecting unit determines that the second terminal of the audio apparatus is a ground terminal and the first terminal is a signal input terminal when a value of the first direct current signal is greater than a value of the second direct current signal, and the switch unit further connects the second terminal to ground according to the determination result of the detecting unit.

4. The combo-jack detecting circuit as claimed in claim 1, wherein the detecting unit determines that the first terminal of the audio apparatus is a ground terminal and the second terminal is a signal input terminal when a value of the first direct current signal is smaller than a value of the second direct current signal, and the switch unit further connects the first terminal to ground according to the determination result of the detecting unit.

5. The combo-jack detecting circuit as claimed in claim 1, further comprising: a second stage buffer, being coupled to a common mode contact and having a first input terminal, a second input terminal, a first output terminal and a second output terminal, wherein the first input terminal of the second stage buffer is coupled to the first output terminal of the first stage buffer and receives the first alternating current signal, the second input terminal of the second stage buffer is coupled to the second output terminal of the first buffer and receives the second alternating current signal, the first output terminal of the second stage buffer, according to the first alternating current signal, the second alternating current signal and a common mode voltage signal of the common mode contact, outputs a third alternating current signal which is based on a level of the common mode voltage signal, and the second output terminal of the second stage buffer, according to the first alternating current signal, the second alternating current signal and the common mode voltage signal of the common mode contact, outputs a fourth alternating current signal which is based on the level of the common mode voltage signal so that the audio codec encodes and decodes audio according to the third alternating current signal and the fourth alternating current signal.

6. A combo-jack detecting circuit for use in an audio codec, connecting with an audio apparatus electrically, the audio apparatus comprising a first terminal and a second terminal, the combo-jack detecting circuit comprising:

a switch unit, being coupled to the first terminal and the second terminal, and selectively switching to output a first voltage signal of the first terminal or a second voltage signal of the second terminal;

a detecting unit, being coupled to the switch unit to receive the first voltage signal and the second voltage signal, and determining a jack type of the audio apparatus according to the first voltage signal and the second voltage signal;

a low pass filter, being coupled between the switch unit and the detecting unit; wherein the low pass filter receives the first voltage signal and the second voltage signal via the switch unit and provides a first direct current signal of the first voltage signal and a second direct current signal of the second voltage signal respectively, and the detecting unit determines the jack type of the audio apparatus according to the first direct current signal and the second direct current signal;

wherein the switch unit further comprises:

a first switch set, including a first detection control switch and a first ground control switch, wherein the low pass filter is coupled to the first terminal via the first detection control switch, and the first ground control switch is coupled between the second terminal and a first ground end; and a second switch set, including a second ground control switch and a second detection control switch, wherein the low pass filter is coupled to the second terminal via the second detection control switch, and the second ground control switch is coupled between the first terminal and a second ground end; wherein the low pass filter provides the first direct current signal of the first voltage signal via the first detection control switch when the first ground control switch and the first detection control switch are switched on and the second ground control switch and the second detection control switch are switched off, and the low pass filter provides the second direct current signal of the second voltage signal via the second detection control switch when the second ground control switch and the second detection control switch are switched on and the first ground control switch and the first detection control switch are switched off.

7. The combo-jack detecting circuit as claimed in claim 6, wherein, and the detecting unit further detects a first peak voltage of the first direct current signal and a second peak voltage of the second direct current signal, and determines the jack type of the audio apparatus according to the first peak voltage and the second peak voltage.

8. The combo-jack detecting circuit as claimed in claim 7, wherein the detecting unit determines that the first terminal of the audio apparatus is a signal input terminal and the second terminal is a ground terminal when the first peak voltage of the first direct current signal is greater than the second peak voltage of the second direct current signal, and the switch unit further connects the second terminal to ground according to the determination result of the detecting unit.

9. The combo-jack detecting circuit as claimed in claim 7, wherein the detecting unit determines that the second terminal of the audio apparatus is a signal input terminal and the first terminal is a ground terminal when the first peak voltage of the first direct current signal is smaller than the second peak voltage of the second direct current signal, and the switch unit further connects the first terminal to ground according to the determination result of the detecting unit.

10. A combo-jack detecting circuit for use in an audio codec, connecting with an audio apparatus electrically, the audio apparatus comprising a first terminal and a second terminal, the combo-jack detecting circuit comprising:

a switch unit, being coupled to the first terminal and the second terminal, and selectively switching to output a first voltage signal of the first terminal or a second voltage signal of the second terminal;

a detecting unit, being coupled to the switch unit to receive the first voltage signal and the second voltage signal, and determining a jack type of the audio apparatus according to the first voltage signal and the second voltage signal;

a low pass filter, being coupled between the switch unit and the detecting unit; wherein the low pass filter receives the first voltage signal and the second voltage signal via the switch unit and provides a first direct current signal of the first voltage signal and a second direct current signal of the second voltage signal respectively, and the detecting unit determines the jack type of the audio apparatus according to the first direct current signal and the second direct current signal, wherein the detecting unit determines that the second terminal of the audio apparatus is a ground terminal and the first terminal is a signal input terminal when a value of the first direct current signal is greater than a value of the second direct current signal, and the switch unit further connects the second terminal to ground according to the determination result of the detecting unit, and a first stage buffer, having a first input terminal, a second input terminal, a first output terminal and a second output terminal, wherein the first input terminal of the first stage buffer is coupled between the switch unit and the low pass filter to receive the first voltage signal, the second input terminal of the first stage buffer is coupled between the low pass filter and the detecting unit to receive the first direct current signal, the first output terminal and the second output terminal of the first stage buffer respectively output a first alternating current signal corresponding to the first voltage signal and a second alternating current signal corresponding to the first direct current signal, and phases of the first alternating current signal and the second alternating current signal are opposite.

11. The combo-jack detecting circuit as claimed in claim 10, further comprising: a second stage buffer, being coupled to a common mode contact and having a first input terminal, a second input terminal, a first output terminal and a second output terminal, wherein the first input terminal of the second stage buffer is coupled to the first output terminal of the first stage buffer and receives the first alternating current signal, the second input terminal of the second stage buffer is coupled to the second output terminal of the first stage buffer and receives the second alternating current signal, the first output terminal of the second stage buffer, according to the first alternating current signal, the second alternating current signal and a common mode voltage signal of the common mode contact, outputs a third alternating current signal which is based on a level of the common mode voltage signal, and the second output terminal of the second stage buffer, according to the first alternating current signal, the second alternating current signal and the common mode voltage signal of the common mode contact, outputs a fourth alternating current signal which is based on the level of the common mode voltage signal so that the audio codec encodes and decodes audio according to the third alternating current signal and the fourth alternating current signal.

* * * * *